United States Patent [19]

Sundar

[11] 4,002,716

[45] Jan. 11, 1977

[54] SULFIDE PRECIPITATION METHOD OF SEPARATING URANIUM FROM GROUP II AND GROUP III METAL IONS

[75] Inventor: Parameshwaran S. Sundar, Pittsburgh, Pa.

[73] Assignee: Westinghouse Electric Corporation, Pittsburgh, Pa.

[22] Filed: Aug. 23, 1973

[21] Appl. No.: 390,997

[52] U.S. Cl. ..... 423/10; 423/8; 423/11; 423/15

[51] Int. Cl.[2] ..... C01G 43/00

[58] Field of Search ..... 423/10, 17, 15, 8, 11

[56] References Cited

UNITED STATES PATENTS

| | | | |
|---|---|---|---|
| 2,815,263 | 12/1957 | Eldredge | 423/17 |
| 2,949,339 | 8/1960 | Marvin | 423/17 |
| 3,178,257 | 4/1965 | Hart | 423/17 |
| 3,239,306 | 3/1966 | Reusser et al. | 423/17 |
| 3,239,307 | 3/1966 | Reusser | 423/17 |

OTHER PUBLICATIONS

Palei, Analytical Chemistry of the Elements–Uranium, 1970, p. 265.

Hurst et al., ORNL–TM–2522 "Solvent Extraction of Uranium from Phosphoric Acid" pp. 1–39.

*Primary Examiner*—Brooks H. Hunt
*Attorney, Agent, or Firm*—R. D. Fuerle

[57] ABSTRACT

Uranium is separated from analytical Group II and Group III metal ions in an aqueous liquor containing uranyl ions. The liquor is extracted with a non-interfering, water-immiscible, organic solvent containing a reagent which will react with the uranyl ions to form a complex soluble in the solvent. If the liquor is acidic, the solvent is washed with water. Then to the solvent is added an aqueous solution containing about 0.5 to 1.0 mole per liter of $(NH_4)_2CO_3$ or $NH_4HCO_3$ ions and sufficient sulfide ions to precipitate the metal ions as sulfides. The solvent and the aqueous solution are separated and the sulfides filtered from the aqueous solution. The ammonium-uranyl-tricarbonate in the aqueous solution can then be precipitated by increasing the concentration of $(NH_4)_2CO_3$ or $NH_4HCO_3$ ions to about 1.5 to 2.5 moles per liter. The precipitate is filtered and calcined to obtain $U_3O_8$ or $UO_2$.

21 Claims, 1 Drawing Figure

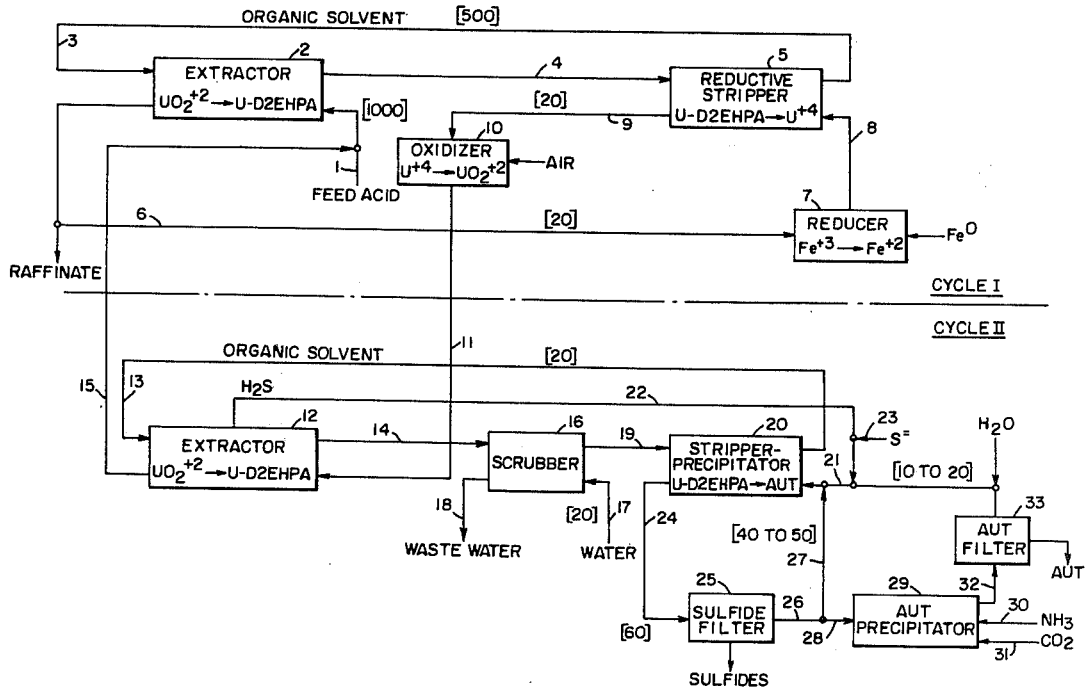

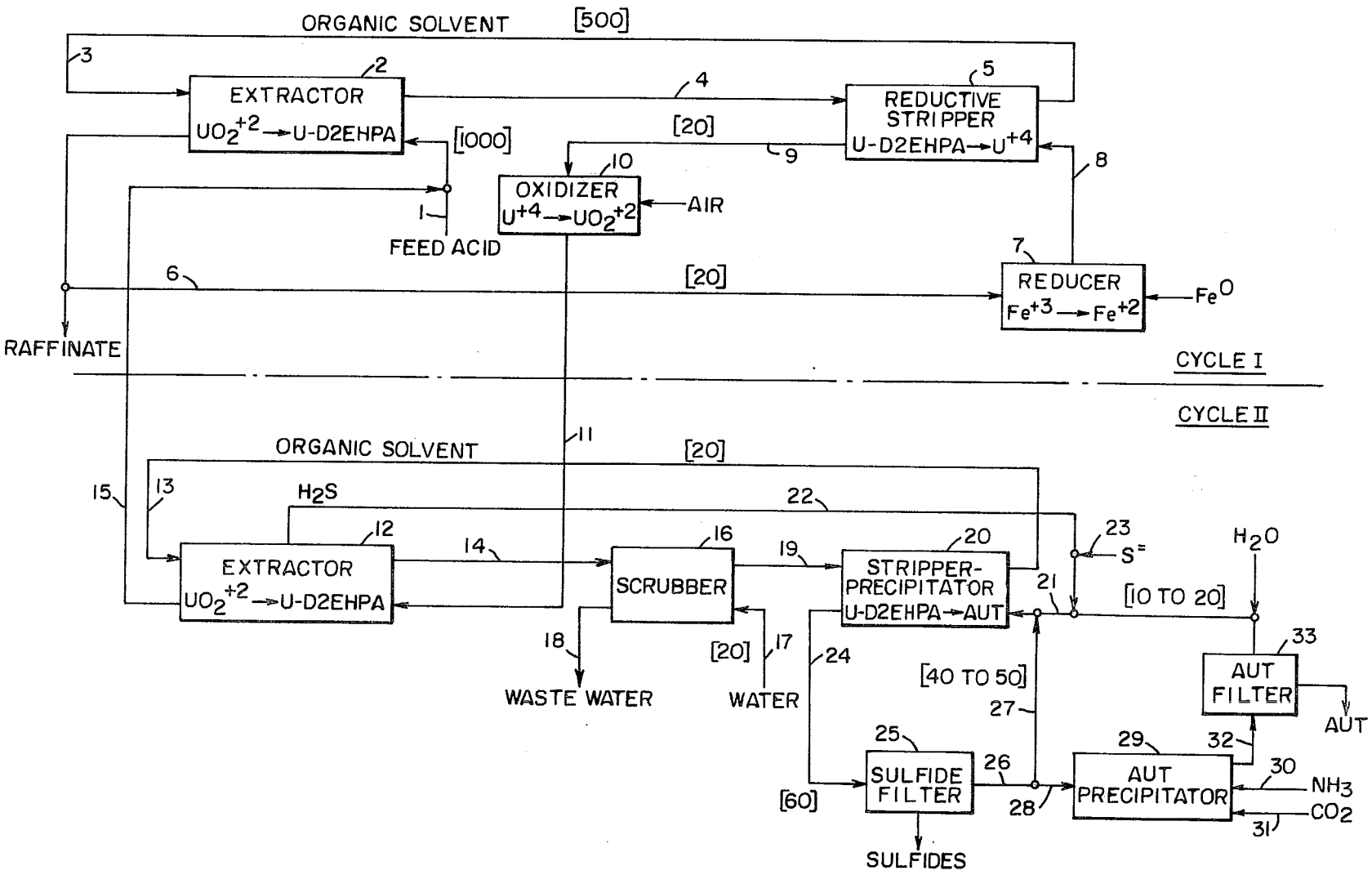
ORGANIC SOLVENT
[500]
EXTRACTOR
$UO_2^{+2} \rightarrow$ U-D2EHPA
REDUCTIVE STRIPPER
U-D2EHPA $\rightarrow U^{+4}$
REDUCER
$Fe^{+3} \rightarrow Fe^{+2}$
$Fe^0$
CYCLE I
CYCLE II
[20]
[1000]
FEED ACID
AIR
OXIDIZER
$U^{+4} \rightarrow UO_2^{+2}$
RAFFINATE
ORGANIC SOLVENT
$H_2S$
EXTRACTOR
$UO_2^{+2} \rightarrow$ U-D2EHPA
SCRUBBER
WATER
WASTE WATER
STRIPPER-PRECIPITATOR
U-D2EHPA $\rightarrow$ AUT
$S^=$
[10 TO 20]
[40 TO 50]
$H_2O$
AUT FILTER
AUT
AUT PRECIPITATOR
$NH_3$
$CO_2$
SULFIDE FILTER
SULFIDES
[60]

SULFIDE PRECIPITATION METHOD OF SEPARATING URANIUM FROM GROUP II AND GROUP III METAL IONS

CROSS-REFERENCE TO RELATED APPLICATIONS

This application is related to application Ser. No. 411,889, filed Nov. 1, 1973 by P. S. Sundar and W. L. Lyon entitled "Coupled Cationic And Anionic Method Of Separating Uranium."

This application is also related to application Ser. No. 411,886, filed Nov. 1, 1973 by L. Elikan, W. L. Lyon, and P. S. Sundar entitled "Uranium Complex Recycling Method of Purifying Uranium Liquors."

BACKGROUND OF THE INVENTION

Fertilizer is made from a phosphoric acid liquor which incidentally contains significant amounts of uranium, typically about 0.2 g/l. In order not to waste the valuable uranium a process has been developed by Oak Ridge National Laboratories to separate it from the acidic liquor which is contaminated with metal ions, principally iron in a typical amount of from 12 g/l. (See the article in I&EC Process Design and Development, Vol. II, page 122, January 1972 by F. J. Hurst, D. J. Crouse, and K. B. Brown titled "Recovery of Uranium from Wet-Process Phosphoric Acid".) The same process is described in more detail by F. J. Hurst et al in ORNL-TM-2522 Report titled "Solvent Extraction of Uranium From Wet-Process Phosphoric Acid", April 1969. Also see U.S. AEC Report, ORNL 2952, June 30, 1960 by F. J. Hurst and D. J. Crouse, titled "Recovery of Uranium from D2EHPA Extractant with $(NH_4)_2CO_3$".)

The prior process is divided into two extraction cycles. In the first cycle the uranyl ion ($UO_2^{+2}$) and some ferric ion is extracted using di-2-ethylhexyl phosphoric acid (D2EHPA) and tri-n-octyl phosphine oxide (TOPO) in kerosene, the uranyl ion forming a complex with the D2EHPA and TOPO. The solvent is then stripped with a portion of the acid leaving the extractor and containing ferrous ion to produce a concentrated acidic aqueous stream of ferric and $U^{+4}$ ions. The $U^{+4}$ is then oxidized with air to the uranyl ion.

In the second cycle of the prior process the concentrated acidic aqueous stream from the first cycle was again extracted with kerosene containing D2EHPA and TOPO, then stripped with water containing 2 to 2.5 moles/l $(NH_4)_2CO_3$ which would precipitate ammonium-uranyl-tricarbonate, $(NH_4)_4UO_2(CO_3)_3$, (AUT) and some ferric hydrate. The AUT could then be recrystallized to purify it.

This process typically produced uranium containing 2 to 4% iron (based on the uranium) before recrystallization and recovered about 94% of the uranium in the feed. Ceramic grade uranium, which is used as fuel in reactors, requires no more than 0.04% iron (based on the uranium). (All percentages herein are by weight unless otherwise indicated.)

SUMMARY OF THE INVENTION

We have invented a process for separating uranium from an aqueous liquor containing uranyl ion and contaminated with analytical Groups II and III metal ions. In our process the first cycle may be the same as the prior process or may be some other process. In the second cycle the aqueous liquor is extracted into an organic solvent which is stripped with a solution containing about 0.5 to 1 mole/l of $(NH_4)_2CO_3$ or $NH_4HCO_3$ ions and sufficient sulfide ion to precipitate the contaminant metal ions as sulfides which are filtered off. The purified AUT can be precipitated from the aqueous solution by raising the concentration of $(NH_4)_2CO_3$ or $NH_4HCO_3$ to about 1.5 to 2.5 moles/l. The precipitate is filtered and calcined to produce $U_3O_8$ or $UO_2$.

The iron contamination in the product of our process is typically about 0.005 to 0.03% (based on the uranium) and more than 99% of the uranium in the feed is recovered. The product is therefore ceramic grade uranium and can be used as reactor fuel without further purification. The cost of obtaining ceramic grade uranium with our process is considerably less than the cost of the prior process (including the recrystallization the prior process required).

DESCRIPTION OF THE INVENTION

The accompanying drawing is a diagram illustrating a certain presently preferred process according to this invention. Typical flow rate ratios are given in the drawing in brackets and may be taken as gal/hr., gal/min., etc. The process is preferably at ambient temperature as that is least expensive. The process is described for continuous operation, but it is understood that adjustments may be needed in flow rates, concentrations, etc. during start-up.

CYCLE I

Referring to the drawing, in Cycle I feed acid from line 1 enters extractor 2. This feed is typically a hot aqueous solution of phosphoric or sulfuric acid having a pH of about 1 to about 2 and containing about 0.1 to about 0.5 g/l of uranium (as the uranyl ion, $UO_2^{+2}$) and about 7 to about 15 g/l of iron (as $FE^{+++}$). In the extractor the feed acid is mixed with a water-immiscible, organic solvent from line 3 containing a reagent which reacts with the uranyl ions to form a complex soluble in the solvent. Typically, the solvent is kerosene in a 0.1 to 10 feed acid to solvent ratio (by volume) and it contains about 0.1 to 1 mole/l of D2EHPA and about 0.025 to about 0.25 mole/l of TOPO. The D2EHPA exists as the dimer $H([CH_3(CH_2)_7]_2PO_4)_2$. Two dimers react with a uranyl ion to form the complex $UO_2H_2([CH_3(CH_2)_7]_2PO_4)_4$, denoted herein as U-D2EHPA.

The solvent, enriched with the complexed uranium but contaminated with ferric ions, passes through line 4 to reductive stripper 5. A portion of the raffinate from extractor 2 passes through line 6 reducer 7 where iron ($Fe^{\circ}$) is added to reduce enough ferric ions to bring the ferrous ion concentration up to at least about 25 g/l. The ferrous ion enters reductive stripper 5 by line 8 and is oxidized there to the ferric ion reducing the uranyl ion complexed with D2EHPA to the quadravalent $U^{+4}$ ion. While the ferrous ion is preferred because of its low cost, other reducing ions could also be used to reduce the uranium to the $U^{+4}$ ion. The $U^{+4}$ ion is not complexed by D2EHPA and therefore enters the aqueous stream in line 9. The ratio of solvent in line 4 to raffinate in line 8 is typically about 40 to about 50. The organic solvent leaving the stripper is then recycled through line 3 to extractor 2.

Finally, the $U^{+4}$ ion in line 9 is oxidized, usually with air, to the uranyl ion in oxidizer 10 to enable the uranium to be extracted again in Cycle II. The product from Cycle I typically has a pH of about 1 to 2 and contains about 25 to 40 g/l iron and about 5 to 15 g/l uranium.

CYCLE II

The aqueous liquor entering Cycle II in line 11 should contain at least about 0.1 g/l of uranium in order for the process to collect practical quantities of uranium. Should the aqueous liquor contain less than 0.1 g/l of uranium then Cycle I can be repeated until sufficient enrichment is obtained. The uranium is in the hexavalent state (i.e., the uranyl ion) and if it is not it is oxidized to make it hexavalent. The aqueous liquor also contains metal ions from Groups II or III or both, most commonly principally iron. There is no upper limit on the concentration of these metal ions, although additional sulfide ion may have to be used to precipitate them if their concentration is very high. The pressure of chlorides, fluorides, or nitrates in the aqueous liquor interferes with the extraction by the organic solvent but small concentrations will not render the process inoperable. Typically, the aqueous liquor will contain phosphoric acid and/or sulfuric acid and have a pH of about 1 to 4; of the two, phosphoric acid is more common and the process of this invention is particularly applicable to phosphoric acid liquors.

Referring to the drawings, aqueous liquid in line 11 from Cycle I enters extractor 12 in Cycle II. The liquor is mixed with a non-interfering, water-immiscible, organic solvent from line 13 containing a reagent which reacts with the uranyl ions in the liquid to form a complex soluble in the solvent. The ratio (by volume) of the aqueous liquor to the solvent is preferably about 0.1 to about 10 since at less than about 0.1 dispersions may form (although there are ways to handle that problem) and at more than about 10 the uranium is unnecessarily diluted. A ratio of about 1.0 seems to work best. The solvent is preferably an aliphatic compound as the uranium complexes are very soluble in them and they aid in the extraction process. Kerosene, a mixture of linear hydrocarbons having 10 to 14 carbon atoms, is the preferred solvent as it is inexpensive and commercially available. Other suitable solvents include benzene, n-heptane, n-octane, chloroform, etc.

The reagent in the solvent used to form the uranium complex is preferably a di-alkyl phosphoric acid having 4 to 10 carbon atoms in each chain when the liquor is a phosphoric acid liquor. The preferred di-alkyl phosphoric acid is di-2-ethyl-hexyl phosphoric acid (D2EHPA) because it is very effective in extracting uranium. If the liquor is a sulfuric acid liquor or a sodium carbonate liquor organic phosphates, phosphonates, phosphine oxides, or amines, can be used as reagents. The concentration of reagent is typically about 0.1 to about 1 mole/l.

The amount of uranium extracted can be increased and the phase separation between the aqueous liquor and the solvent can be improved if about 0.025 to about 0.25 mole/l of a synergistic agent is included in the solvent. Synergistic agents are selected to be compatible with the reagent used as is known to the art. For example, if D2EHPA or a similar compound is the reagent, a trialkylphosphate, trialkylphosphonate, trialkylphosphinate or trialkyphosphine oxide can be used as a synergistic agent, where the alkyl chains are linear from $C_4$ to $C_{10}$. Tri-n-octyl phosphine oxide (TOPO) is preferred for use with D2EHPA as it is highly effective.

The aqueous liquor from extractor 12 is recycled through line 15 to extractor 2 in Cycle I. The organic solvent, containing complexed uranium contaminated with Group II or III metal ions, leaves extractor 12 through line 14. If the aqueous liquor was acidic the organic solvent in line 14 is preferably scrubbed with water in scrubber 16 to remove the acid because the presence of the acid can cause a secondary dispersion or entrainment of small drops of acid in the organic solvent which consumes ammonia. Water enters scrubber 16 by line 17 and waste water leaves by line 18. The scrubbed organic solvent then passes through line 19 to stripper-precipitator 20.

In the stripper-precipitator 20 the organic solvent is mixed with an aqueous solution containing about 0.5 to about 1 mole/l of ammonium carbonate, ammonium bicarbonate, or a mixture thereof introduced from line 21. Ammonium carbonate is preferred to the bicarbonate as it is the compound that is complexed with uranium. Since, whenever ammonium carbonate is present the bicarbonate will also be present, "ammonium carbonate" will be used hereinafter as including ammonium bicarbonate. The amount of $(NH_4)_2CO_3$ used is critical since if less than about 0.5 mole/l is used emulsions begin to form which produces poor phase separation, and if more than about 1 mole/l is used ammonium uranyl carbonate (AUT) may precipitate if the concentration of uranium is high. The $(NH_4)_2CO_3$ forms AUT which dissolves in the solution, stripping the uranium from the organic solvent. The ratio (by volume) of aqueous solution to organic solvent is preferably about 1 to about 3 since at less than about 1 emulsions may begin to form and at more than about 3 the uranium is unnecessarily diluted.

Sufficient sulfide ion is also introduced into stripper-precipitator 20 to precipitate Group II and III metal ions as sulfides. About 1 to 1.1 times the stoichiometric amount of sulfide ion required to precipitate the metal ions is sufficient. The sulfide ion may be introduced as ammonium sulfide or hydrogen sulfide. Hydrogen sulfide is preferred as it is the least expensive and is easy to control, transport and handle. The hydrogen sulfide freed from extractor 12 is brought into the $(NH_4)_2CO_3$ or $NH_4HCO_3$ solution through line 22 although additional sulfide ion may be added through line 23 to make up for losses.

The organic solvent is separated from the aqueous solution and is recycled through line 13. The aqueous solution containing AUT and the precipitated sulfides passes through line 24 to sulfide filter 25 where the Groups II and III sulfides are filtered off. The solubility of these sulfides is so low that the filtrate is virtually free of Groups II and III metal ions. At this point the separation is complete and the uranium can be obtained from the filtrate by many processes, for example, evaporation. The following, however, describes the preferred process of this invention.

The filtrate, in line 26, is divided into two streams, one in line 27 and the other in line 28. The filtrate in line 27 is recycled to stripper-precipitator 20 and the remaining filtrate in line 28 is sent to AUT precipitator 29. Sufficient additional $(NH_4)_2CO_3$ is added to the filtrate in the AUT precipitator to raise the concentration of $(NH_4)_2CO_3$ to about 1.5 to about 2.5 which causes the AUT to precipitate. The concentration of $(NH_4)_2CO_3$ is critical since if less than about 1.5 mole/l is used much of the uranium will not precipitate and more than about 2.5 moles/l of $(NH_4)_2CO_3$ will not dissolve at ambient temperatures. About 2 to about 2.5 moles/l of $(NH_4)_2CO_3$ is preferred to precipitate as much uranium as possible. The $(NH_4)_2CO_3$ is preferably added as ammonia and carbon dioxide gases (lines 30 and 31, respectively) since gases are easily monitored and their use avoids the necessity of dissolving solid $(NH_4)_2CO_3$. It is also possible to precipitate ammonium diuranate (ADU), a complex of hydrated uranyl hydroxide and a salt, for example $[UO_2(OH)_2; 0.5(NH_4)_2CO_3; 0.5\ H_2O]$, but the precipitation of AUT is preferred as it is easier to filter.

From AUT precipitator 29 the precipitate slurry passes through line 32 to filter 33 where the precipitated AUT is filtered off. The remaining filtrate is recycled through line 21 to prevent the loss of AUT which has not precipitated.

The balance between the streams in lines 27 and 28 depends upon the uranium concentration in line 19. If the concentration of uranium in the stream 19 is high a large proportion of stream 26 is sent to line 28. This is because the high $(NH_4)_2CO_3$ requirement to strip the high uranium in stream 19 has to be supplied through stream 21 or stream 32. However, if the uranium concentration in stream 19 is low less of stream 26 is diverted to AUT precipitator 29 in order to avoid precipitating AUT in stripper-precipitator 20. Typically, about 1/5 to about ½ of line 26 is sent to line 28 and the remainder to line 27. Typical dissolved uranium concentrations are about 7.5 g/l in line 26, about 1.6 g/l in line 32 and about 3.0 to 5.0 g/l in line 21 after mixing with line 27. The concentration of uranium in line 21 cannot, of course, reach saturation (about 7.5 g/l) or the uranium will precipitate.

The precipitated AUT can be calcined in an oven at about 350° to about 900° which drives off carbon dioxide and ammonia. If the calcining is done in a reducing atmosphere, such as a hydrogen-nitrogen mixture, $UO_2$ is obtained. If the calcining is done in an oxidizing atmosphere, such as air, the mixed oxide $U_3O_8$ is obtained.

The following example further illustrates this invention.

EXAMPLE

The organic solvent (line 13 in drawing) was kerosene containing 0.3 M D2EHPA and 0.75 M TOPO. For extractor 12 of the drawing a single stage mixer-settler and a three stage mixer-settler were used. Line 13 entered the single stage mixer-settler so that FeS in the organic solvent in that line could be scrubbed with the raffinate from the three-stage mixer-settler using an aqueous to organic volume ratio of 1.0. This single-stage unit was controllable, completely effective, and operated smoothly. Analysis of the organic solvent leaving this single-stage mixer-settler showed a higher concentration of Fe (about 0.6 g/l). The scrubber organic solvent then entered the three stage mixer-settler counterflowing against a 5.3 M phosphoric acid stream containing 13 g/l U and 25 g/l Fe.

The extract (line 14) was scrubbed with water in three counter-current stages in scrubber 16 to remove any $PO_4^{-3}$ from the organic solvent. The scrubbed extract contained about 12 g/l U and about 0.13 g/l Fe.

For stripper-precipitator 20 of the drawing was used a single-stage mixer-settler. The extract from line 19 was contacted with a 0.5 M $(NH_4)_2CO_3$ aqueous solution containing 0.01 M ammonium sulfide at an aqueous to organic ratio (by volume) of 3.0. Throughout the operation an aqueous continuous phase was maintained in the mixer portion of this mixer-settler. Only a fraction of the FeS precipitate transferred into the aqueous phase and the build-up of FeS in the settler portion was so heavy that the organic-aqueous interface was hidden.

However, no phase separation problems were encountered and the mixer-settler separation was quite satisfactory over a range of mixer impeller speeds. No precipitate buildup at the interface and little precipitate settled at the bottom of the settler were observed.

Stream 24 was continuously passed through a 3 $\mu$ filter (25 in the drawing). The FeS precipitate was washed, dissolved in HCl, and found to contain only trace quantities of uranium.

About 9 liters of the filtrate containing about 3.6 g/l uranium was contacted with gaseous $NH_3$ and $CO_2$. Using a contactor with a raked bottom for AUT precipitator 29, the $NH_3$ and $CO_2$ gases were bubbled through the $(NH_4)_2CO_3$ liquor with mixing and the liquid was allowed to overflow into a settler where the precipitate settled. The liquor was then recycled back to the contactor section. A 2 to 1 $NH_3$ to $CO_2$ molar ratio was maintained and after about 6 hours sufficient AUT had collected for analytical purposes. The AUT was crystalline and could be isolated with medium filter paper. On analysis it was found to contain 279 ppm (0.03%) iron and 133 ppm sulfur (based on uranium). Since this unit was operated as a semi-batch reactor, the amount of AUT collected was small, and no quantitative results were sought.

What I claim is:

1. A method of separating uranium from iron in an acidic aqueous liquor containing uranyl ion comprising:

1. extracting the uranium from said liquor with a non-interfering, water-immiscible, organic solvent containing a reagent which reacts with said uranyl ion to form a complex soluble in said solvent, said solvent moving in a closed loop;
2. in either order
   a. mixing with said solvent an aqueous solution containing about 0.5 to about 1 mole per liter of ions selected from the group consisting of $(NH_4)_2CO_3$, $NH_4HCO_3$, and mixtures thereof, ½ to 4/5 of said aqueous solution being recycled in a closed loop, and
   b. contacting said recycled aqueous solution with sufficient sulfide ion to precipitate said metal ions as sulfides, said uranium remaining in solution;
3. permitting said solvent and said aqueous solution to separate;
4. separating said precipitated sulfides from said recycled aqueous solution;
5. adding to the 1/5 to ½ of said aqueous solution which was not recycled sufficient ions selected from the group consisting of $(NH_4)_2CO_3$, $NH_4HCO_3$, and mixtures thereof to bring said ion concentration in said non-recycled aqueous solution to about 1.5 to about 2.5 moles per liter, causing said uranium to precipitate as ammonium-uranyl-tricarbonate;
6. filtering said uranium precipitate from said aqueous solution; and
7. calcining said filtered uranium precipitate.

2. A method according to claim 1 wherein said aqueous liquor is acid, including between steps (1) and (2) the step of scrubbing said solvent with water.

3. A method according to claim 2 wherein said liquor initially has a pH of about 1 to about 4 and contains an acid selected from the group consisting of phosphoric acid, sulfuric acid, and mixtures thereof, at least about 400 ppm of said metal ions, and at least about 0.1 grams per liter of uranyl ion.

4. A method according to claim 3 wherein said acid is phosphoric acid.

5. A method according to claim 1 wherein said reagent is a compound having the general formula

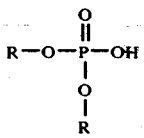

where each R is an alkyl group from $C_4$ to $C_{10}$.

6. A method according to claim 5 wherein said compound is di-2-ethyl-hexyl phosphoric acid.

7. A method according to claim 6 wherein said solvent includes about 0.025 to about 0.25 moles per liter of a synergistic agent.

8. A method according to claim 7 wherein said synergistic agent is tri-octyl phosphine oxide.

9. A method according to claim 1 wherein said solvent is an aliphatic compound.

10. A method according to claim 9 wherein said solvent is a linear hydrocarbon having 10 to 14 carbon atoms.

11. A method according to claim 1 wherein the amount of said reagent is about 0.1 to about 1 mole per liter of said solvent.

12. A method according to claim 1 wherein the volume ratio of said liquor to said solvent is about 0.1 to about 10.

13. A method according to claim 1 wherein the concentration of said ion in said aqueous solution is 2 to 2.5 moles per liter.

14. A method according to claim 1 wherein said filtered uranium precipitate is calcined at about 350° to about 900° C.

15. A method according to claim 14 wherein said calcining is done in an oxidizing atmosphere to produce the mixed oxide $U_3O_8$.

16. A method according to claim 14 wherein said calcining is done in a reducing atmosphere to produce $UO_2$.

17. A method according to claim 1 wherein the filtrate of said aqueous solution is recycled to the aqueous liquor of step (1).

18. A method according to claim 1 wherein the volume ratio of said aqueous solution to said solvent is about 2 to about 3.

19. A method according to claim 1 wherein said sulfide ion is produced by the addition of a compound selected from the group consisting of hydrogen sulfide, ammonium sulfide, and mixtures thereof.

20. A method according to claim 19 wherein said sulfide ion is produced by the addition of hydrogen sulfide.

21. A method according to claim 1 wherein hydrogen sulfide produced in step (1) is recycled to step (2).

* * * * *

UNITED STATES PATENT AND TRADEMARK OFFICE

CERTIFICATE OF CORRECTION

PATENT NO. : 4,002,716

DATED : January 11, 1977

INVENTOR(S) : Parameshwaran S. Sundar

It is certified that error appears in the above-identified patent and that said Letters Patent are hereby corrected as shown below:

Column 2, line 45, cancel "$H([CH_3(CH_2)_7]_2PO_4)_2$" and substitute -- $H_2([CH_3(CH_2)_7]_2PO_4)_2$ --.

Column 8, line 21, cancel "liquor" and substitute -- solution --; same line, cancel "(1)" and substitute -- (2) --

Signed and Sealed this

Thirty-first Day of May 1977

[SEAL]

*Attest:*

RUTH C. MASON
*Attesting Officer*

C. MARSHALL DANN
*Commissioner of Patents and Trademarks*